United States Patent [19]

Cerkvenik et al.

[11] Patent Number: 4,768,459

[45] Date of Patent: Sep. 6, 1988

[54] CANOE SEAT/CARRYING YOKE

[75] Inventors: Gary E. Cerkvenik, Mountain Iron, Minn.; Theodore D. Newberg, Box 257, Mountain Iron, Minn. 55768

[73] Assignee: Theodore D. Newberg, Mountain Iron, Minn.

[21] Appl. No.: 82,963

[22] Filed: Aug. 4, 1987

Related U.S. Application Data

[63] Continuation of Ser. No. 800,729, Nov. 22, 1985, abandoned.

[51] Int. Cl.[4] ..... A45F 3/15

[52] U.S. Cl. ..... 114/363; 114/364

[58] Field of Search ..... 114/343, 347, 363, 364, 114/65 R; 441/43, 130, 129; 297/3, 195, 207

[56] References Cited

U.S. PATENT DOCUMENTS

| | | | |
|---|---|---|---|
| 2,671,231 | 3/1959 | Massiootte | 114/347 |
| 2,815,517 | 12/1957 | Andresen | 114/364 |
| 3,718,365 | 2/1973 | Gibson | 114/363 |
| 3,958,289 | 5/1976 | Carlson | 114/364 |
| 3,990,743 | 11/1976 | Nelson | 114/363 |
| 4,016,615 | 4/1977 | Main | 114/347 |
| 4,236,267 | 12/1980 | Lewis | 114/347 |
| 4,380,208 | 4/1983 | Goserud | 114/364 |

*Primary Examiner*—Sherman D. Basinger
*Assistant Examiner*—Clifford T. Bartz
*Attorney, Agent, or Firm*—Douglas L. Tschida

[57] ABSTRACT

Apparatus removably mountable between the gunwales of a canoe and supporting a pad containing frame assembly therebetween. The frame assembly serving as an extra seat in a first position and as a carrying yoke in a second inverted position. In its various embodiments, the frame assembly mounts to the canoe gunwales in removable locking relation to permit reversal of the frame assembly between its seat and carrying positions. In the various embodiments, the locking mechanism comprises: spring loaded, notched, tubular clamps; channeled nylon blocks; pivoting cantilevered arms; and mating keyways, lockbolts and lockpins.

20 Claims, 3 Drawing Sheets

CANOE SEAT/CARRYING YOKE

This is a continuation of application Ser. No. 800,729, filed Nov. 22, 1985, now abandoned.

BACKGROUND OF THE INVENTION

The present invention relates to devices for use in recreational canoeing and, in particular, to a reversible assembly mountable between the gunwales of a canoe which acts as a seat in a first position and as a carrying yoke in a second reversed position.

Depending upon the individual, recreational canoeing may mean anything from a leisurely paddle around a lake's shoreline to an extended canoe trip into the boundary waters or other generally inaccessible watercourses. Depending too upon the intended use, one typically selects a canoe style to be compatible therewith, and because of which canoes are constructed in varying lengths, widths and weights, not to mention having third seats and to permit rowing and the use of outboard motors. Accordingly, in the former example, no particular requirements may apply, other than possibly cost. In the latter example, however, the canoeing enthusiast typically expresses a good deal of concern over the weight and materials from which the canoe is constructed. These points being of special concern, given the necessity of oftentimes having to portage the canoe as well as to provide necessary space for equipment and paddlers.

In this latter regard, one of the principle means developed since the inception of the canoe and still used today is the carrying yoke and which the canoeist employs when portaging the canoe from one watercourse to another or where beaver dams and other obstructions require the canoeist to walk around the obstruction.

As most commonly constructed, the yoke comprises a frame assembly that allows a single canoeist to support and carry the canoe on his/her shoulders during portage. This method being preferred to dragging or otherwise carrying the canoe from a more awkward posture that may require two people. Thus, upon supporting the yoke at the approximate center of the canoe, a single person can carry the canoe on his/her shoulders, while traversing the portage pathway. By also tipping the fore-end of the canoe slightly upward, the canoeist is readily able to view the path while maintaining an even weight distribution. In this way, the canoe can be readily transported by a single person while a second paddler can carry any necessary backpacks or other equipment. Then too, if the amount of equipment requires, multiple trips can be made to ferry the equipment from one waterway to the next.

While a conventional carrying yoke forms the mainstay of the canoeist, it is believed to suffer on at least two accounts. First, at the expense of its weight, however negligible, it serves only a single purpose. Second, because the yoke is typically designed on a "one size fits all" basis, they do not provide any adjustability or permit carrying the canoe from more than one position. Assuming therefore that the yoke could be made to perform multiple functions, while accommodating canoeists of different sizes and physiques, its utility would be further accentuated.

It is in this latter regard that the present invention was developed and the intent of which is to construct a combinational device which can serve not only as a carrying yoke, but also as a third seat and/or lashing point, such as when securing equipment to the canoe to prevent it from falling out when shooting rapids or the like.

Accordingly, a primary object of the invention is that it be adaptable to a variety of different size and shapes of canoes and canoeists while permitting a positive, reversible fastening thereto. A reversible fastening system being desired to minimize the complexity of the mounting and which must act to positively secure the seat/yoke to the canoe in either of its various positions.

It is a further object of the invention that the present seat/yoke be light in weight, since during portage, every ounce becomes a pound, especially when portaging several kilometers.

It is a still further object of the invention that it provide for a positive interlock when the frame is in its various positions to prevent against either the canoe slipping from the canoeist's shoulders or the canoeist falling from the seat.

It is still another object of the invention that it allow the canoeist to vary his carrying position and/or shift the weight of the canoe about the shoulders.

The above objects, advantages and distinctions, as well as the construction of the present invention, will however become more apparent upon directing attention to the following description and which is made relative to the appended drawings. Before referring to the description, it is to be appreciated though that even though the presently preferred embodiment as well as various alternative embodiments are described, this description should not be deemed to be self-limiting. Rather, it is intended to merely instruct one of skill in the art in how to construct and use the present invention and which it is to be appreciated can be constructed in not only the following described ways but also numerous others.

SUMMARY OF THE INVENTION

Apparatus including attaching means mountable to the opposed gunwales of a canoe and a pad containing frame assembly reversibly removably mounted therebetween for serving as a seat in a first position and as a carrying yoke in a second inverted position.

In one construction, the attaching means comprise a pair of tubular members having opposed notched ends for receiving the tubular ends of one side of the frame assembly in mating relation thereto. A spring-loaded internally mounted plunger assembly restrains the frame ends under spring tension. An associated D-shaped hairpin catch interlocks with the tubular members and frame ends to prevent shifting against the spring tension.

The frame assembly comprises a pair of bent lateral tubular supports which are held in spaced apart parallel relation to one another via associated cross-bracing. A pair of cushioned support pads are longitudinally secured therebetween in a fashion to permit the adjustment of the spacing between the pads. The pads can thereby be adjusted to accommodate the shoulder spacing of the canoeist, while also providing appropriate seating support.

In another embodiment, the clamp means comprise four nylon blocks mounted to the canoe gunwales to slidably receive the ends of the frame assembly. Two of the blocks are mounted to one gunwale and each include a laterally disposed bore or covered channel. The other two blocks are mounted in opposed relation to the first two and each include a lateral channel with an overlying pivoting latch. The ends of one side of the frame assembly may thus be first inserted into the non-latched blocks, before the other ends are lowered into the latched channel blocks, and after which the latches may be rotated to secure the frame assembly to the canoe.

In a related alternative embodiment, the non-latched blocks are mounted to opposite gunwales to receive the opposed ends of one of the lateral frame members, while the other latched blocks are mounted to opposed gunwales to receive the ends of the other lateral member in the seat position. Upon unlatching and rotating the frame ends 180 degrees, the ends may be brought to rest either on the tops of the canoe gunwales or in a third set of non-latched channel blocks, with the frame in the yoke position. In this regard, it is to be further appreciated that the seat position will be slightly offset from center in order to permit the frame assembly 8 to be pivoted to the balance point of the canoe.

In another embodiment, the clamp means comprises four lateral bore containing slip blocks which in combination with a frame assembly having lateral frame members with lengthened ends permits the alternate slidable mounting of the pairs of frame ends therein. Cross pins may also be used with any of the foregoing alternative clamp assemblies to prevent the spreading of the gunwales and the release of the seat/yoke frame assembly.

In yet another embodiment, the frame assembly is suspended from opposed pairs of pivoting arms and each of which are pivotally secured at one end to the gunwale and at an opposed end to a pivot point at the frame assembly. Thus, in a lowered position, the frame acts as a seat, while in a raised position as a carrying yoke. In the raised position, additional means serve to lock the frame in extended relation to the top of the canoe gunwales.

In still another embodiment, the frame assembly is constructed to include integral right and left keyway containing side members and which keyways are mountable into lockbolt assemblies attached to the tops of the gunwales. An attendant lockpin mounted to the lockbolt via a spring steel leaf and associated holes in the side members adjacent the keyways assures a positive locking action in either of the seat or yoke positions. In lieu of a permanently mounted lockbolt and lockpin, it is also contemplated that a lockpin insertable through the side members and gunwales and having a plurality of mounting holes may be used in combination with a D-shaped hairpin. A retainer cord securing the hairpin to the lockpin minimizes against loss of either.

DESCRIPTION OF THE PREFERRED EMBODIMENT

Figure 1:
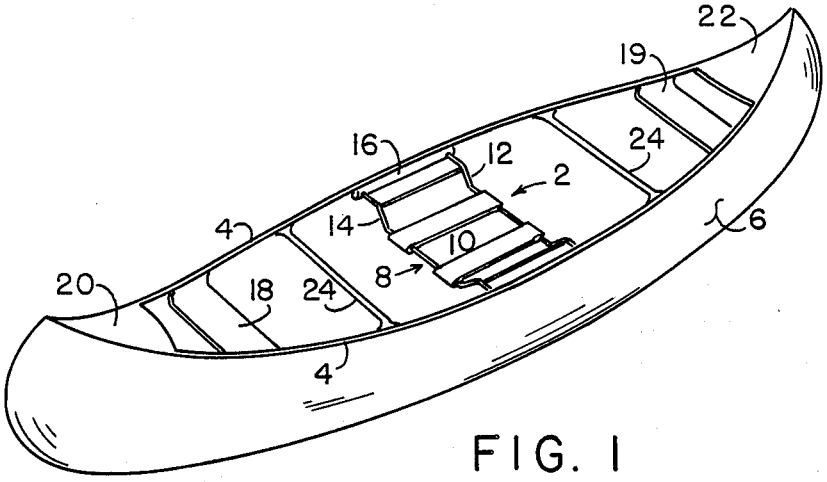
FIG. 1 shows a perspective view of a canoe with the present seat/carrying yoke suspended from the canoe gunwales in its seat position.

Referring to FIG. 1, a perspective view is shown of the present seat/carrying yoke 2 in mounted relation to the gunwales 4 of a typical canoe 6. The seat/yoke assembly 2 is positioned generally centrally of the canoe and comprises a tubular frame assembly 8 having a pair of pads 10 slidably mounted along opposed U-shaped lateral frame members 12 and 14 and which permit the spacing between the pads 10 to be adjusted so as to best accommodate the user during seating or carrying.

The frame assembly 8 is attached to the canoe 6 at the gunwales 4 via tubular, spring-loaded clamps 16 that are boltably mounted to the gunwales 4, but only one of which is shown in FIG. 1. The clamps 16 releasably secure the frame assembly 8 to the canoe 6 and permit the canoeist to reverse the position of the seat/yoke assembly 2 as desired. Specifically and as drawn, the seat/yoke assembly 2 is shown in its seat position or with the pads 10 recessed into the canoe interior. During portaging, however, it is desirable to reverse the seat/yoke assembly 2 such that the pads 10 extend outwardly of the canoe interior approximately four and one-half inches above the gunwales 4 such that upon placing the head between the pads 10 and supporting the canoe 6 on one's shoulders, sufficient head space is provided within the interior of the canoe while permitting the canoeist sufficient visibility, upon tipping the rear end of the canoe downward. Greater lateral visibility is also provided thereby over conventional yokes. Given too the space between the lateral members 12 and 14, the canoeist can change the weight distribution slightly without re-positioning the yoke and is also now able to grasp the canoe gunwales in a fashion that provides improved circulation in the arms and hands.

As depicted in FIG. 1, the canoe 6 generally comprises a two-seat canoe 6 and which seats 18 and 19 are respectively positioned just to the rear of the bow 20 and forward of the stern 22. A pair of thwarts 24 are, in turn, mounted to the rear of the bow seat 18 in front of the stern seat 19. A third thwart 24 is most commonly included at the center of the canoe, but which is replaced upon the mounting of the present seat/yoke assembly 2. While the thwarts are intended to stabilize the gunwales 4, the loss of the center thwart has not been found to present any major disadvantages, and is overweighed by the advantages of the present seat/yoke assembly 2. In this regard, while the present frame assembly 8 is not pinned against lateral movement at the opposed clamps 16, and which pinning would cause the assembly 2 to act much the same as a thwart, it will become apparent hereinafter that the inclusion of such functionality can be easily accomplished by a simple modification to the present assembly. In any case, the present assembly 2 provides advantageous application to most canoes, without adding extraneous weight, while at the time incorporating the advantages of an integral third seat/carrying yoke and lashing point into a single structure. Thus, it is perceived that the present invention will find advantageous application with most canoes.

As presently constructed, the seat/yoke assembly 2 is constructed from solid rod or hollow tubular aluminum stock, although it is to be appreciated that any other lightweight metal would work, such as stainless steel. For sake of economy, though, aluminum is presently preferred. Kevlar TM members would probably be an optimum material, but also the most expensive. Applicant has also constructed the frame assembly 8 from laminated wood and which finds application with cedar strip canoes and the like.

Figure 2:
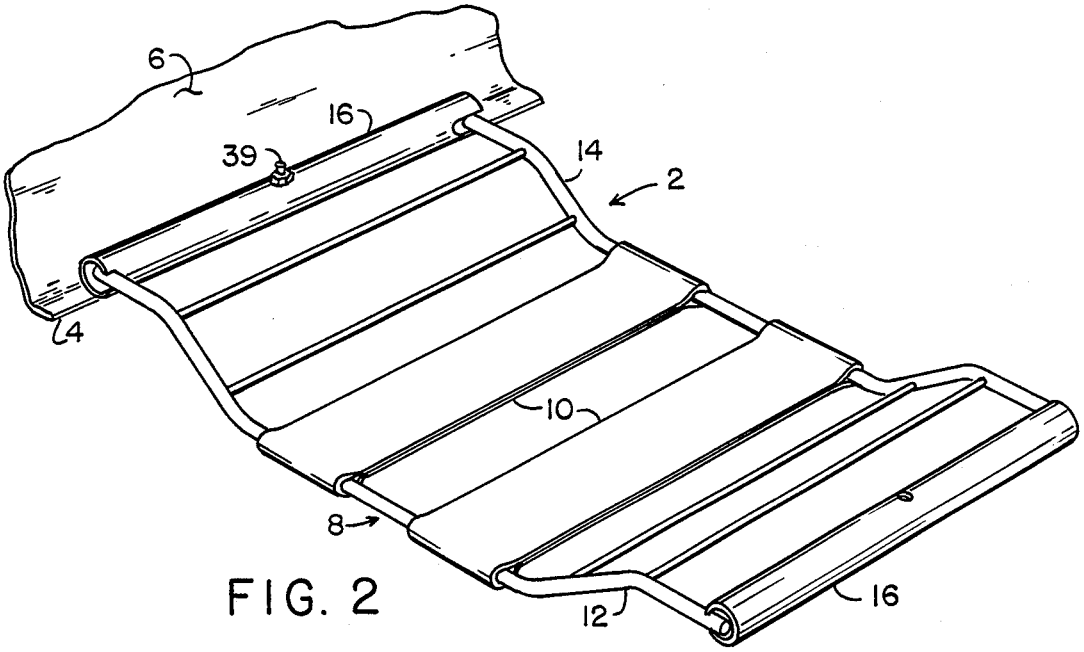
FIG. 2 shows a perspective upside-down view in partial cutaway relative to the canoe and wherein the seat/carrying yoke is shown in its carrying position.

Directing attention next to FIG. 2, a perspective assembly view is shown of the seat/yoke assembly 2 in partial cutaway relative to the upside-down canoe 6. The seat/yoke assembly 2 is shown in its yoke position and which is the reverse of the seat position. Due to the forming of the lateral tubular members 12 and 14 in a U-shape, the assembly 8 in this position extends above the gunwales 4 to provide the necessary head space upon balancing the yoke assembly 2 on the canoeist's shoulders.

Figure 3:
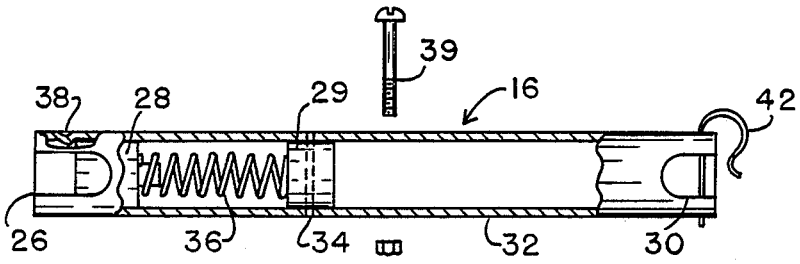
FIG. 3 shows a front elevation view in partial cutaway of one of the spring-loaded mounting clamps that are secured to the canoe gunwales and which support the seat/yoke frame assembly.

Turning attention next to FIG. 3, a front elevation view in partial cutaway is shown of one of the tubular clamp members 16 and the pair of which allow the reversible mounting of the frame assembly 8 within the canoe 6. Recalling from FIGS. 1 and 2 that a pair of the clamps 16 are secured to the undersides of the upper bent edges of the canoe gunwales 4 in opposed relation to one another, in order to mount the frame assembly to the clamps 16, it is first necessary to insert the opposed ends of one of the lateral members 12 and 14 into the longer of the two slots 26 in abutment with the spring-loaded plunger 28 of each of the clamps 16. Upon pushing the lateral frame member 12 or 14 rearwardly, the plunger member 28 is depressed against the spring tension eventually to the point where the other lateral frame member 12 or 14 can be pivoted inwardly of the canoe gunwales and brought into engagement with the opposed slot 30 in each of the clamps 16. Upon releasing the frame assembly, the stop member 28 then locks the ends of the lateral members 12 and 14 into each of the clamps 16. Reversal of the frame assembly 8 being achieved by merely reversing the above order of mounting.

As presently constructed, each of the clamp members 16 generally comprises a length of one inch inside diameter tube stock or tube member 32 approximately 14 to 18 inches long for a frame assembly 8 of 30 to 36 inches width. The slots 26 and 30 are cut wide enough to receive the one-half inch inside diameter tube stock that is typically used for the lateral frame members 12 and 14. The slot 26, in turn, is cut to a depth of approximately two and one-half inches and the slot 30 to a depth of one and one-half inches, along the same longitudinal line. A spring stop 29 and stop pin 34 are mounted interiorly of the tube member 32 forward of the notch 30 a sufficient distance to restrain one end of the spring 36 yet not permit the plunger 28 to extend beyond the member 16. The spring 36, and which has a sufficient spring constant to restrain the frame assembly 8 against most jostling is thereafter inserted along with the plunger 28. With the plunger 28 depressed, the tube member 32 is next crimped at crimp 38 to prevent the plunger 28 from coming out of the tube 32. Thus, the plunger 28 and spring 36 are constrained within the tube member 32.

The clamp members 16 are mountable to the canoe gunwales via any suitable fasteners, such as sheet metal screws, band clamps or through bolts and nuts 39. As presently constructed, through bolts and nuts 39 are used and which are secured during mounting through holes that are bored through the tops of the canoe gunwale and the walls of the tubular member 32. During this mounting, however, care must be had to insure that the through bolts and nuts 39 do not obstruct movement of the plunger 28 or the insertion of the ends of the lateral frame members 12 and 14 into the slots 26 and 30.

Figure 3A:
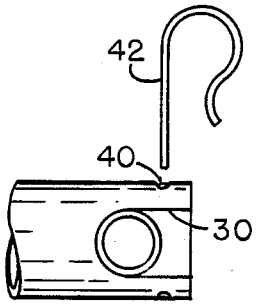
FIG. 3*a* shows a detailed view of one of the clamp ends relative to a D-shaped hairpin used to lock the seat/yoke frame assembly to the clamp.

Directing attention next to FIG. 3*a*, a detailed view is shown of the slot 30 containing end of one clamp member 16, in relation to one end of one of the lateral members 12 or 14 as it would be positioned, upon mounting the frame assembly 8 within the clamps 16. While it is to be appreciated that the frame assembly 8 is restrained to the clamps 16 via the force of the spring 36, it is till possible for the frame assembly 8 to shift rearwardly, thereby disengaging the tubular member 12 or 14 mounted within the slot 30 from the clamp 16. In order to prevent this circumstance or relegate it to desired times, a through hole 40 is bored through the tubular member 32 just rearwardly of the ultimate position of the frame member for receiving a D-shaped hairpin clip 42. Specifically, the straight portion of the clip mounts through the through hole 40, while the arcuate portion snaps over the outer tube walls. The lateral member 12 or 14 is thus be constrained within the notch 36 into the left of the clip 42, thereby preventing the frame assembly from coming out of the clamps 16 at undesired times.

Relative to the previously mentioned loss of a thwart 24, it is also to be appreciated that the ends of each of the lateral members 12 and 14 can be pinned or otherwise formed so that they cannot be laterally pulled out from the clamps 16. For example, a stop pin 62 like that to be mentioned in regard to the embodiment of FIG. 5 may be used but which will become more apparent hereafter.

Figure 4:
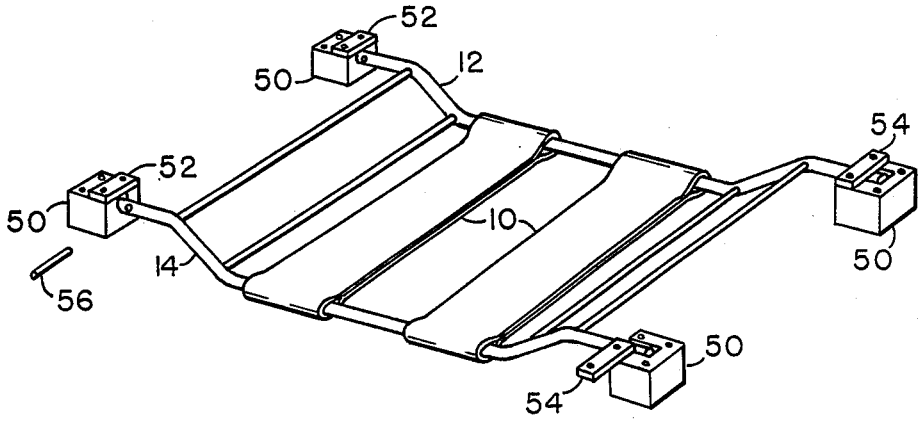
FIG. 4 shows a perspective view of the seat/yoke frame assembly relative to a number of alternative channeled support blocks.

Directing attention next to FIG. 4, a perspective view is shown of an alternative embodiment of the present invention and wherein the ends of the lateral members 12 and 14 are secured to individual nylon support blocks 50. Specifically, each of the blocks 50 is constructed to have a U-shaped channel for receiving one end of one of the tube members 12 or 14. Of the four blocks 50, the two leftmost blocks include a plate 52 secured to the upper surface of the block, thus relegating the movement of the frame assembly 8 relative thereto to a sliding action. The rightmost blocks, in turn, contain a pivoting latch member 54. Thus, the mounting operation for this embodiment requires the canoeist to first insert the ends of one side of the frame assembly 8 into the plate 52 containing blocks 50 whereupon the opposite sides are lowered into the latch 54 containing blocks 50. The pivot latches are then pivoted into overlying relation to secure the frame assembly 8 to the gunwales 4. A deficiency of the embodiment of FIG. 4, however is that greater care is required when mounting each of the blocks 50 to the lower edges of the gunwales 4. Whereas with the clamps 16 it is necessary only to ensure that they are mounted in opposed relation, now it is necessary to properly align four blocks 50. In passing, it should also be noted that a stop pin 56 is provided at the end of at least one of the lateral members 12 or 14 to limit the insertion depth of the frame assembly 8 into the plate 52 containing blocks 50. Pins 56 may alternatively be inserted through holes in the blocks 50 to prevent lateral shifting of either the frame or canoe sidewalls.

Figure 5:
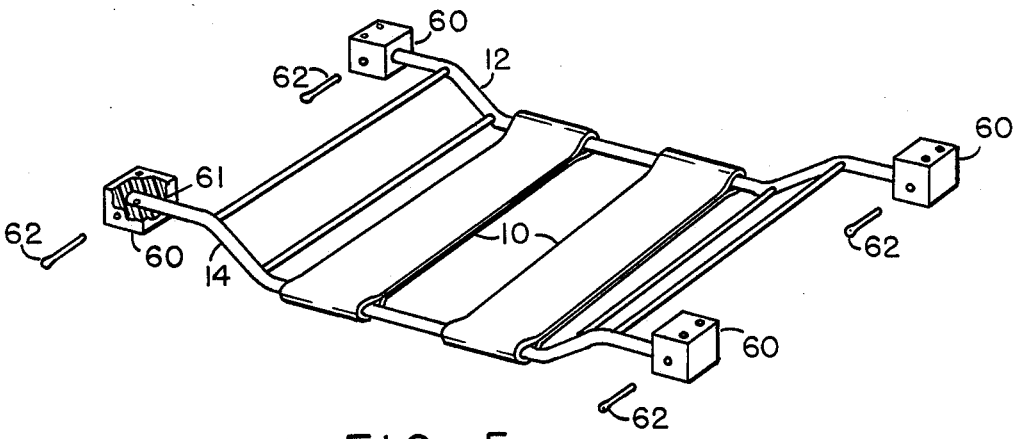
FIG. 5 shows a view of a seat/yoke frame assembly like that of FIG. 4, rotated 90 degrees, relative to an alternative plurality of bored fastener blocks.

Turning attention next to FIG. 5, yet another alternative embodiment is shown and wherein four bored nylon mounting blocks 60 are employed. Each of the blocks 60 is again mounted to the underside of the canoe gunwales 4 for receiving one end of one of the lateral frame members 12 or 14. Now, however, each of the blocks 60 includes a centrally positioned bore 61 for receiving the end of one of the lateral frame member 12 or 14.

Mounting of the frame assembly 8 to the blocks 60 is achieved by first inserting one side of the frame assembly into one pair of blocks 60 to a depth sufficient to allow the opposed ends of the lateral frame members 12 and 14 to slip into the opposed blocks 60. The frame assembly 8 is next slid into these opposed blocks a sufficient depth and whereafter pins 62 can be inserted into the opposed ends of at least one or more of the lateral members 12 or 14 between the canoe walls and the blocks 60, thereby preventing the frame assembly 8 from coming loose of the clamp blocks 60.

Figure 6:
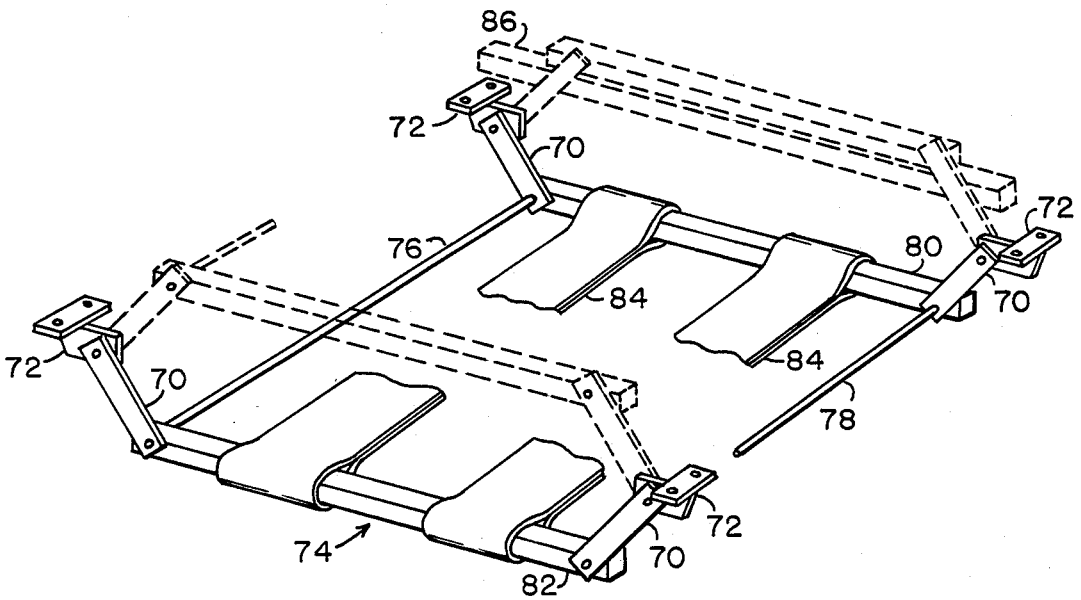
FIG. 6 shows a perspective view of yet another seat/yoke assembly mounted in scissoring relation to the canoe gunwales, the assembly being shown in solid line in its lowered seat position and in phantom line in its carrying yoke position.

Turning attention next to FIG. 6, yet another embodiment of the invention is shown in a partially cutaway perspective view relative to its mounting to the gunwales 4. As depicted, this embodiment is shown in solid line in its seat position and in phantom line in its yoke position. While generally achieving the same result as the frame assemblies described in the earlier FIGS. 1 through 5, the embodiment of FIG. 6 is constructed to pivot up and down relative to the gunwales 4 via a number of pivoting link arms 70 that are fixedly coupled at the underside of the gunwales 4 via associated couplers 72 secured to the gunwales 4 and at their opposed end in pivoting relation to a centrally mounted frame assembly 74. Specifically, the link arms 70 are coupled to right and left rod-like members 76 and 78 that are secured between the lateral frame members 30 80 and 82. A pair of pads 84, as before, are slidably mounted to the lateral members 80 and 82. In its lowermost or seat position, the frame assembly 74 again rests interiorly of the canoe 6 in suspended relation to the gunwales 4 via the link arms 70. During portaging, however, the frame assembly 74 may be raised to its yoke position and which is maintained, for example, by a piece of wood 84 inserted between the frame assembly and the canoe gunwales 4. Alternatively, it is to be appreciated that in lieu of a piece of wood 84, a lock mechanism might be incorporated into one or more of the link arms 70 to maintain the link arms 70 in locked relation to the canoe 6.

Still another embodiment of the invention that has been constructed essentially looks like that of FIG. 4, however, the support blocks 50 have been re-positioned so that the frame assembly 8 is pivotally secured to the canoe 6. Specifically, the frame assembly 8 is offset rearwardly of center and the opposed ends of the lateral frame members 12 are pivotally secured in the two plate 52 containing blocks 50 and which are now mounted on opposed gunwales 4. The ends of the other lateral member 14 are, in turn, received within two re-positioned support blocks 50 having only channels formed therein. Upon thus pivoting the lateral member 14 resting within the channel containing blocks in a 180-degree arc, the opposed ends of the member 14 can be brought to bear in resting relation to the upper gunwale surfaces, with the frame assembly 8 in its yoke position. Still further, if the width of the gunwales at this point are not sufficient to permit the frame member ends to rest thereon, a third set of channel blocks might be mounted to the canoe gunwales for receiving the ends of the frame member, with the frame assembly 8 in its yoke position. Again, though, the necessity of a third set of channel blocks further complicates the mounting of the present invention.

Recognizing further the potential of the canoe sidewalls to flex when the seat/yoke assembly 2 is positioned in its seat position, yet another embodiment of the invention is contemplated and which essentially combines the clamp members 16 with the frame assembly 8 to achieve a unitary structure that is mountable to the tops of the canoe gunwales 4. In this regard, attention is particularly directed to FIG. 7 and wherein such a seat/yoke assembly is shown. As before, the assembly is comprised of a pair of lateral frame members 12 and 14 and between which are suspended a pair of pads 10 and various cross braces. Mounted now however to the lateral ends of the lateral members 12 and 14 are rectangular tube stock members 90. The members 90 being secured to the lateral members 12 and 14 via sheet metal setscrews, other suitable fasteners and/or welding etc. While not shown in FIG. 7, it is also to be appreciated that cross-bracing members may also be employed between the lateral members 12 and 14. Let through the side members 90, approximately midway along their lengths, are keyways 92 (only the upper two of which are shown). Associated lockpin holes 96 are also provided through the upper and lower surfaces of the members 90, adjacent the keyways 92 (again only two of which lockpin holes 96 are shown). Plastic end caps 94 are now also provided at each of the ends of the members 90 to minimize against potential injury.

Figure 8:
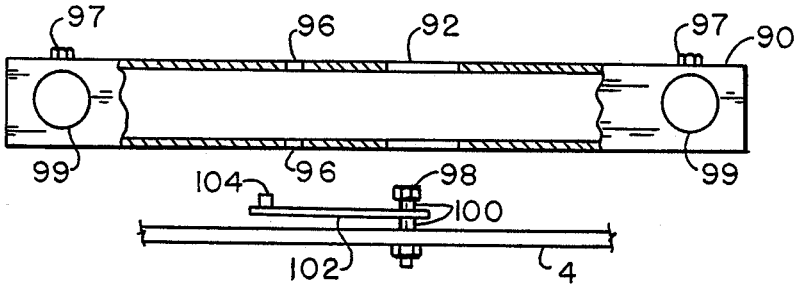
FIG. 8 shows a partial cross-section through one side of the seat/yoke assembly relative to the gunwale and lockbolt.

Turning attention next to FIG. 8, a partially cross-section view is shown through one of the side members 90 relative to its manner of locking engagement with the canoe gunwales 4. From FIG. 8, the nature of the keyways 92 and lockpin holes 96 becomes more apparent, as well as the mounting relation of the lateral members 12 and 14 to the side members 90. In this latter regard, it is to be noted that lateral member receiving holes 99 are let through the walls of the side members 90 off-center of the tubular stock so as to minimize the distance between the ends of the lateral members 12 and 14 and the attendant sheet metal screws 97 used to secure the lateral members 12 and 14 thereto.

In order to secure the seat/yoke assembly to the canoe 6, a pair of lockbolts 98 (only one of which is shown) are mounted in opposed relation to one another along the canoe gunwales 4, approximately midway along the length of the canoe 6. Secured between the head of the lockbolt 98 and the top of the gunwales are a pair of shims 100, a side-wise extending spring steel leaf 102 and to one end of which is mounted a lockpin 104. Upon thus positioning the widest diameter portion of the keyways in one surface of the side members 90 above the lockbolts 98, the heads of the lockbolts 98 can be inserted into the side members 90, with the side members subsequently being slid so as to position the head of the lockbolt 98 in the narrowest portion of the keyway 92. At the same time, the lockpin 104 is depressed downwardly by the side members 90, but upon the side members 90 reaching approximately the extreme end of the narrowest portion of the keyways 92, the lockpins 104 flex upwardly and engage the lockpin holes 96. Thus, the seat/yoke assembly 2 is restrained in one of its two positions. The opposite position is achievable by merely rotating the seat/yoke assembly 2 and reversing the above-mentioned process.

Figure 7:
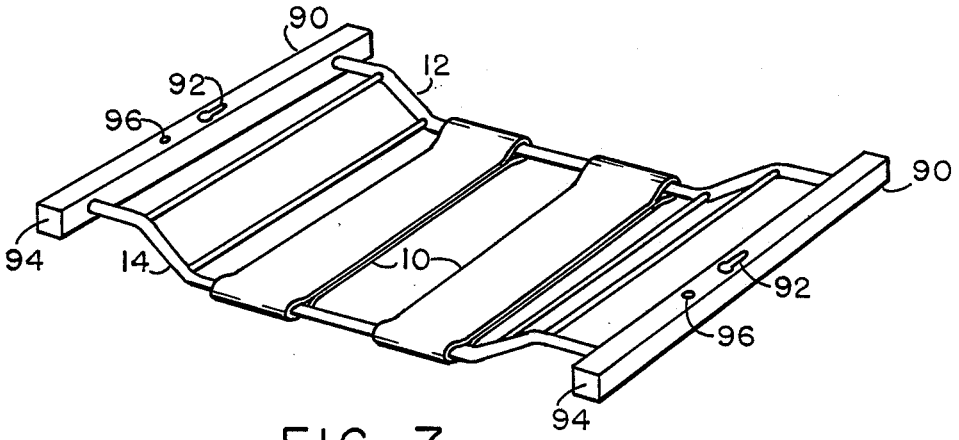
FIG. 7 shows a perspective view of a keyway containing seat/yoke assembly which mounts to the top of the canoe gunwales.
Figure 9:
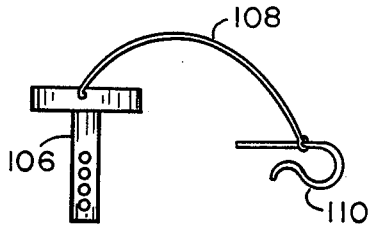
FIG. 9 shows a view of an alternative locking bolt that may be used with the seat/yoke assembly of FIG. 7.

In simplification of the embodiment of FIGS. 7 and 8, it is still further contemplated that in lieu of a lockbolt 98, shims 100, spring steel leaf 102 and lockpin 104, alternatively the keyways 92 may only comprise holes bored through the side members 90. In this regard and turning attention to FIG. 9, it is to be appreciated that upon positioning the holes in the side members over corresponding through holes in the gunwales 4, a lockpin 106 could be inserted therethrough. Depending then upon the combined thickness of the side members 90 and gunwales 4, one or more of the holes provided through the lockpin 106 would be exposed and able to receive a D-shaped hairpin 110. To minimize against the possibility of losing the hairpin 110 or dropping it into the water, a retainer cord 108 is also provided.

From the foregoing embodiments, it should be apparent that the present invention while providing numerous advantages over the prior art, can be constructed in numerous configurations. Each of these configurations further achieving an assembly which may operate in one position as a seat and in a reverse or inverted position as a carrying yoke. Thus, it is contemplated that the breadth of the foregoing invention as set forth in the claims hereafter should not be limited to any one particular embodiment, but should be interpreted so as to include all those equivalent embodiments within the spirit and scope thereof and which might suggest themselves to those of skill in the art. Further, it is to be appreciated that while the present invention has been described with respect to its presently preferred embodiment and various alternative embodiments, the invention should not be limited thereto or thereby.

What is claimed is:

1. Apparatus for a canoe comprising:

(a) a frame assembly including first and second rigid primary support members, each primary support member having a substantially horizontal center portion vertically offset from alligned outer end portions, a plurality of cross brace members maintaining said primary support members in planar parallel relation to one another and first and second support pads of a combined width less than the center portion slidably suspended along and between the center portions of said primary support members; and (b) means permanently secured to opposite gunwales of the canoe and mating with the opposite ends of said frame assembly and including latch means for releasably securing the frame assembly thereto in a seat position with said center portion below the gunwales and in a carrying position with the center portion above the gunwales.

2. Apparatus as set forth in claim 1 including:

(a) first and second tubular clamp members mounted in opposed parallel relation to one another along the canoe's gunwales, each having a first notch longitudinally extending inwardly from an edge at one end and a second notch at the opposite end, and wherein the first notch is cut to a depth approximately twice that of said second notch; and (b) spring bias means mounted within each of said first and second clamp members for securing the outer end portions of said frame assembly in the first and second notches upon depressing the spring bias means of each clamp member with the outer end portions of one frame member and inserting the outer end portions of the other frame member in the second notch.

3. Apparatus as set forth in claim 2 where said spring bias means comprises:

(a) first and second plug members, said first plug member slidably mounted and said second plug member fixedly mounted within said tubular clamp member;

(b) a spring mounted between said first and second plugs; and (c) means for limiting the travel of said first plug member to a point along the length of said first notch.

4. Apparatus as set forth in claim 1 wherein said securing means comprises a plurality of block members mounted to the undersides of the canoe gunwales, each block member restrainably supporting an outer end portion of one of the primary support members.

5. Apparatus as set forth in in claim 4 wherein each of the block members includes an outer end portion receiving bore.

6. Apparatus as set forth in claim 5 wherein each outer end portion and block member include aligning through holes and means insertable in the through holes for restraining the frame assembly to the block members.

7. Apparatus as set forth in claim 4 comprising:

(a) a first pair of block members mounted in spaced apart relation along one of the canoe gunwales, each including an outer end portion receiving bore;

(b) a second pair of block members mounted to the opposite canoe gunwale in opposed relation to the bore containing block members, each including an end portion receiving channel; and (c) means for restraining the outer end portions mounted in the channel containing block members.

8. Apparatus as set forth in claim 4 including a pair of block members mounted to the canoe gunwales opposite one another and pivotally supporting the outer end portions of one of the primary support members.

9. Apparatus as set forth in claim 8 including a second pair of block members having outer end portion receiving channels mounted to the canoe gunwales opposite one another and in spaced apart relation to the pivotal block members and supporting the outer end portions of the other support member.

10. Apparatus for a canoe comprising:

(a) a frame assembly including first and second rigid primary support members, each primary support member having a substantially horizontal center portion offset from outer end portions, a plurality of cross brace members maintaining said primary support members in planar parallel relation to one another and first and second support pads slidably suspended along and between the center portion of said primary support members;

(b) first and second tubular clamp members mounted in parallel relation to one another along opposite gunwales of the canoe, each having a first notch longitudinally extending inwardly from an edge at one end and a second notch at the opposite end, and wherein the first notch is cut to a depth approximately twice that of said second notch; and (c) spring bias means mounted within each of said first and second tubular clamp members for securing the outer end portions of one side of said frame assembly in the first and second notches upon depressing said bias means with the ends of one frame member in the first notch and inserting the ends of the other frame member in the second notch.

11. Apparatus as set forth in claim 10 including latch means for preventing the unintentional disconnecting of said primary support members from said clamp members.

12. Apparatus as set forth in claim 11 wherein said latch means comprises a plurality of pins, wherein each pin is mountable in holes let through each clamp member at one of the first and second notches.

13. Apparatus for a canoe comprising:

(a) a frame assembly including first and second rigid primary support members, each primary support member having a substantially horizontal center portion offset from outer end portions, a pair of keyway containing end members mounted between the outer end portions of said first and second primary support members and first and second support pads slidably suspended along and between the center portion of said primary support members; and (b) first and second lock members mounted to opposite canoe gunwales, each lock member having a head portion of a larger circumferential dimension than a lower shank portion, the head portion being slidably insertable into and restrained by said keyways, whereby upon securing said end members in the end member keyways with said center portion below the gunwales, a seat is obtained and with said center portion above the gunwales, a carrying yoke is obtained.

14. Apparatus as set forth in claim 13 wherein said keyways each comprise an elongated hole having a first portion of a size to receive the head portion of the lock member and a contiguous narrower slot portion to receiving the lock member shank portion.

15. Apparatus as set forth in claim 13 including means releasably interlocking with each end member for restraining said frame assembly to the canoe gunwales.

16. Apparatus for a canoe comprising:

(a) a frame assembly including first and second rigid primary support members, each primary support member having a substantially horizontal center portion offset from alligned outer end portions, first and second end members mounted to maintain said first and second primary support members in planar parallel relation to one another and first and second support pads of a combined width less than said center portion slidably suspended along and between said primary support members; and (b) means permanently secured to opposite canoe gunwales and releasably mating in latched relation with the end members for securing the frame assembly to the gunwales of the canoe whereby said frame assembly may be mounted in a seat position with said center portion below the gunwales or inverted to a carrying position with the center portion above the gunwales.

17. Apparatus for a canoe comprising:

(a) a frame assembly including first and second rigid primary support members, each primary support member having a substantially horizontal center portion offset from outer end portions, a plurality of cross brace members maintaining said primary support members in planar parallel relation to one another and first and second support pads slidably suspended along and between the center portion of said primary support members;

(b) a first pair of block members mounted in spaced apart relation along one of the canoe gunwales, each including an outer end portion receiving bore;

(c) a second pair of block members having outer end portion receiving channels mounted to the opposite canoe gunwales; and (d) means for restraining the outer end portions mounted to the channel containing block members.

18. Apparatus for a canoe comprising:

(a) a frame assembly including first and second rigid primary support members, each primary support member having a substantially horizontal center portion offset from outer end portions, a plurality of cross brace members maintaining said primary support members in planar parallel relation to one another and first and second support pads slidably suspended along and between the center portion of said primary support members;

(b) a pair of block members mounted to the canoe gunwales opposite one another and pivotally supporting the outer end portions of one of the primary support members; and (c) a second pair of block members having outer end portion receiving channels mounted to the canoe gunwales opposite one another and in spaced apart relation to the pivotal block members and supporting the outer end portions of the other support member.

19. Apparatus for a canoe comprising:

(a) a frame assembly including first and second rigid primary support members, each primary support member having a substantially horizontal center portion offset from outer end portions, a plurality of brace members maintaining said primary support members in planar parallel relation to one another and first and second support pads slidably suspended along and between the center portions of said primary support members and of a combined width less than said center portions; and (b) a plurality of clamp members permanently mounted opposite one another to the canoe gunwales, each clame member supporting a mating outer end of the frame assembly and including latch means for releasably restraining said frame assembly to said clamp members whereby said frame assembly may be used as a seat by sliding said first and second pads together and as a carrying yoke by separating said first and second pads.

20. Canoe carrying apparatus comprising:

(a) a frame assembly including first and second rigid primary support members, each primary support member having a substantially horizontal center portion offset from outer end portions with outer end portions mount over the tops of the opposite canoe gunwales, a plurality of brace members maintaining said primary support members in planar parallel relation to one another and first and second support pads slidably suspended along and between the center portions of said primary support members and of a combined width less than said center portion; and (b) latch means mounted to the opposite canoe gunwales and mating with portions of said frame assembly for releasbly securing the frame assembly to the opposite canoe gunwales whereby said frame assembly may be used as a carrying yoke by separating said first and second pads.

* * * * *